US010330063B2

(12) United States Patent
Bernhaupt

(10) Patent No.: US 10,330,063 B2
(45) Date of Patent: Jun. 25, 2019

(54) FUEL INJECTOR

(71) Applicant: Robert Bosch GmbH, Stuttgart (DE)

(72) Inventor: Martin Bernhaupt, Oberalm (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/567,025

(22) PCT Filed: Mar. 1, 2016

(86) PCT No.: PCT/EP2016/054285
§ 371 (c)(1),
(2) Date: Oct. 16, 2017

(87) PCT Pub. No.: WO2016/169682
PCT Pub. Date: Oct. 27, 2016

(65) Prior Publication Data

US 2018/0087480 A1 Mar. 29, 2018

(30) Foreign Application Priority Data

Apr. 22, 2015 (DE) ..... 10 2015 207 307

(51) Int. Cl.
*F02M 57/00* (2006.01)

(52) U.S. Cl.
CPC ..... *F02M 57/005* (2013.01); *F02M 2200/24* (2013.01); *F02M 2200/244* (2013.01); *F02M 2200/247* (2013.01)

(58) Field of Classification Search
CPC ..... F02M 2200/24; F02M 57/005; F02M 2200/244; F02M 2200/247
See application file for complete search history.

(56) References Cited

U.S. PATENT DOCUMENTS 4,438,496 A * 3/1984 Ohie ..... F02D 41/14 123/458
4,596,220 A * 6/1986 Oosuga ..... F02D 37/02 123/399

(Continued)

FOREIGN PATENT DOCUMENTS

DE 198 13 756 A1 10/1999
DE 10 2009 026 477 A1 12/2010

(Continued)

OTHER PUBLICATIONS

International Search Report corresponding to PCT Application No. PCT/EP2016/054285, dated Apr. 14, 2016 (German and English language document) (5 pages).

*Primary Examiner* — Hieu T Vo
*Assistant Examiner* — Sherman D Manley
(74) *Attorney, Agent, or Firm* — Maginot, Moore & Beck LLP

(57) ABSTRACT

A fuel injector includes an injector housing, a longitudinally movable nozzle needle, and a force sensing element. The injector housing defines a nozzle chamber, a pressure chamber, and a measuring chamber. The nozzle chamber is configured to be supplied with pressurized fuel via a feed line formed in the injector housing. The pressure chamber is configured to be hydraulically connected to the feed line. The nozzle needle is disposed in the nozzle chamber and is configured to open and to close at least one spray hole. The force sensing element is disposed in the measuring chamber and is configured to detect a pressure in the pressure chamber. The measuring chamber is separated from the pressure chamber by a diaphragm-like intermediate wall. The force sensing element supports the intermediate wall.

14 Claims, 4 Drawing Sheets

(56) References Cited

U.S. PATENT DOCUMENTS 5,103,789 A * 4/1992 Hartman ..... F02B 23/0696 123/435
5,834,629 A * 11/1998 Hammarberg ..... F02D 35/021 73/35.08
5,988,142 A * 11/1999 Klopfer ..... F02M 47/027 123/446
6,318,342 B1 * 11/2001 Simon ..... F02M 51/0603 123/494
6,598,591 B2 * 7/2003 Lewis ..... F02M 47/027 123/467
6,622,549 B1 * 9/2003 Wlodarczyk ..... F02D 35/022 73/114.16
6,929,192 B2 * 8/2005 Schmauser ..... F02M 51/0603 239/102.2
7,530,275 B2 * 5/2009 Wiedemann ..... G01L 23/12 361/283.1
7,568,633 B2 * 8/2009 Sturman ..... F02B 33/22 239/533.1
7,930,934 B2 * 4/2011 Winklhofer ..... G01M 15/10 73/114.79
7,931,009 B2 * 4/2011 Kondo ..... F02M 47/027 123/490
7,963,155 B2 * 6/2011 Kondo ..... F02M 47/027 73/114.43
8,297,259 B2 * 10/2012 Kondo ..... F02M 47/027 123/470
8,365,705 B2 * 2/2013 Kondo ..... F02M 47/027 123/494
8,375,924 B2 * 2/2013 Kondo ..... F02M 47/027 123/494
8,402,950 B2 * 3/2013 Fujino ..... F02M 47/027 123/472
8,474,438 B2 * 7/2013 Kondo ..... F02M 47/027 123/494
8,746,050 B2 * 6/2014 Cueto ..... F02M 65/001 73/114.48
8,919,186 B2 * 12/2014 Kondo ..... F02M 47/027 73/114.51
2009/0038589 A1 * 2/2009 Dingle ..... F02D 41/3827 123/480
2009/0248276 A1 * 10/2009 Kondo ..... F02M 57/005 701/103
2010/0050991 A1 * 3/2010 Cooke ..... F02M 51/005 123/470
2010/0252001 A1 * 10/2010 Morita ..... F02M 51/005 123/472
2010/0263633 A1 * 10/2010 Kondo ..... F02M 47/027 123/478
2010/0307457 A1 * 12/2010 Sugiyama ..... F02D 41/2422 123/478
2010/0312457 A1 * 12/2010 Yoshida ..... F02D 41/28 701/103
2010/0312501 A1 * 12/2010 Komatsu ..... F02D 35/023 702/50

FOREIGN PATENT DOCUMENTS

DE 10 2011 051 765 A1 1/2013
EP 1 042 603 B1 10/2000
EP 2 216 539 A1 8/2010
EP 3 026 254 A1 6/2016
EP 3 032 088 A1 6/2016
EP 3 076 002 A1 10/2016
JP 11-326102 A 11/1999
JP 2009-257303 A 11/2009
JP 2009-293541 A 12/2009
JP 2010-249675 A 11/2010

* cited by examiner

FUEL INJECTOR

This application is a 35 U.S.C. § 371 National Stage Application of PCT/EP2016/054285, filed on Mar. 1, 2016, which claims the benefit of priority to Serial No. DE 10 2015 207 307.6, filed on Apr. 22, 2015 in Germany, the disclosures of which are incorporated herein by reference in their entirety.

BACKGROUND

The disclosure relates to a fuel injector, in particular a common rail injector, as disclosed herein.

A fuel injector as disclosed herein is known from EP 1 042 603 B1. The known fuel injector has within its injector housing a sensor which is arranged in the region of a return bore between a control chamber of the fuel injector and a low-pressure region. In particular, the sensor surrounds the return bore at a sleeve-like section of a component in which the return bore is formed. An end portion of an injection member configured as a nozzle needle projects into the control chamber. The movement of the nozzle needle is controlled in known fashion by influencing the pressure in the control chamber to open spray holes formed in the injector housing in order to inject fuel into the combustion chamber of an internal combustion engine. The pressure in the control chamber is effected by drainage of fuel from said control chamber into the low-pressure region via the return bore or return throttle, it being possible to close the return bore by means of a closing member in the low-pressure region of the injector housing, which closing member can in turn be actuated by means of an actuator, for example a magnetic actuator or a piezo actuator. In the lowered position of the nozzle needle a relatively high (hydraulic) pressure is present in the control chamber and therefore also in the return bore. Upon depressurization of the control chamber, by contrast, fuel flows from the control chamber into the low-pressure region, the hydraulic pressure in the return bore being reduced. The known sensor is designed to detect the pressure or pressure fluctuations in the return bore caused by opening of the closing member leading from the control chamber, from which the position of the nozzle needle can be deduced. A disadvantage of the known arrangement is that the sensor is arranged in the high-pressure region of the injector housing and must therefore be of relatively high-cost construction. In addition, the installation space available for such a sensor in the injector housing is restricted, so that special design solutions, which are critical, in particular, with respect to the strength of the injector housing, must be selected.

A fuel injector having pressure sensing means arranged in the low-pressure region is known from DE 10 2011 051 765 A1. In this case a measuring duct or tap hole leads to a diaphragm-like intermediate wall. The pressure sensing means or force sensing element is arranged on the rear side of the intermediate wall. The pressure sensing means is preferably a measuring strip arrangement of low stiffness, which measures the tensions or deformations arising in the intermediate wall. However, because of the high pressures in the tap hole, problems relating to the strength of the intermediate wall can arise.

SUMMARY

In contrast of the above, the fuel injector according to the disclosure has increased durability in the region of the pressure sensing means because the pressure is not measured by means of a tension or deformation of the intermediate wall. According to the disclosure, the load is measured by a force sensing element as stiff as possible, which supports the intermediate wall, so that the intermediate wall is subjected to practically no deformation.

To this end, the fuel injector includes an injector housing in which a nozzle chamber is configured, which nozzle chamber can be supplied with pressurized fuel via a feed line formed in the injector housing. A longitudinally movable nozzle needle, which opens or closes at least one spray hole, is arranged in the nozzle chamber. The fuel injector further includes a force sensing element for at least indirectly detecting a pressure in a pressure chamber formed in the injector housing. The pressure chamber is hydraulically connectable to the feed line. The force sensing element is arranged in a measuring chamber configured in the injector housing, the measuring chamber being separated from the pressure chamber by a diaphragm-like intermediate wall. According to the disclosure, the force sensing element supports the intermediate wall. In addition, the force sensing element advantageously has very high stiffness. The intermediate wall is therefore reinforced by the support of the force sensing element against the direction of action of the pressure in the pressure chamber which is to be measured, so that the tensions and deflections in the intermediate wall when loaded by the pressure are minimized.

In an advantageous development, the force sensing element is preloaded against the intermediate wall. The high pressure prevailing in the pressure chamber during operation of the fuel injector then counteracts the preloading or deflection of the intermediate wall, so that the deformations and tensions—specifically the tensile loadings—in the intermediate wall and in the surrounding regions are minimized. On the high-pressure side of the intermediate wall the pressure variations are highly dynamic, so that preloading of the intermediate wall by the force sensing element results in a significant increase in durability.

In an advantageous embodiment, the force sensing element is preloaded by a screw element, for example a nut. The preloading of the force sensing element, and therefore of the intermediate wall, can thereby be very precisely adjusted during assembly of the fuel injector.

In another advantageous embodiment, the force sensing element is pretensioned by means of an overdimension inside the injector housing. The force sensing element has an overdimension in relation to the measuring chamber, so that the force sensing element is preloaded simultaneously with the axial clamping of the injector housing during assembly. This is an especially low-cost implementation of the preloading.

In a preferred embodiment of the force sensing element, the latter is configured as a piezoelectric force sensing element. Such an element has the advantage of relatively high measuring sensitivity combined with a compact structure and low manufacturing costs. Furthermore, such a force sensing element can be constructed especially stiff, thereby bracing the intermediate wall very effectively.

In an advantageous embodiment, the pressure chamber is connected hydraulically to the nozzle chamber via a connecting bore. The pressure progression within the nozzle chamber, and therefore the pressure with which the fuel is injected into the combustion chamber of the internal combustion engine, is thereby detected. In this case the connecting bore is advantageously formed in a throttle plate of the injector housing.

In a development of the disclosure, the longitudinal movement of the nozzle needle is controlled by the pressure in a control chamber. The pressure in the control chamber can in turn be controlled, for example, by a pilot valve.

In an advantageous configuration, the pressure chamber is connected hydraulically to the control chamber via a tap hole. The pressure in the control chamber is thereby detected, which pressure predominantly influences the movement of the hydraulically activated nozzle needle. In this case the tap hole is advantageously formed in the throttle plate of the injector housing, in which throttle plate a return throttle from the control chamber to the pilot valve is also formed. The pressure in the control chamber is subjected to larger fluctuations than the pressure in the nozzle chamber. Pressure differences in the control chamber can thereby be determined more reliably than pressure differences in the nozzle chamber.

In advantageous embodiments, a valve chamber is formed in the pilot valve and the control chamber is connected hydraulically to the valve chamber via a return throttle. The nozzle needle is thereby connected as a servo valve. The pilot valve may be configured, for example, as a directly connected solenoid valve. The pressure in the valve chamber is subjected to still larger fluctuations than the pressure in the control chamber. Consequently, the pressure differences can be determined very reliably in this embodiment also.

In an advantageous development, the pressure chamber is connected hydraulically to the valve chamber via a channel. The hydraulic connection from the valve chamber to the pressure chamber is thereby implemented in a very simple manner. In this case the pressure chamber and the channel are advantageously implemented as one volume, for example as a continuous channel, so that the connection between valve chamber and pressure chamber is especially inexpensive.

In another advantageous embodiment the feed line is connected to the pressure chamber. The pressure drop between nozzle chamber and a high-pressure source—that is, approximately the pressure drop of the nozzle chamber—is thereby measured. This embodiment can be implemented at especially low cost and has advantages with regard to the installation space required, since the measurement by the force sensing element may be effected, for example, remotely from the nozzle needle, that is, in a region in which more free installation space89* is present than in a region close to the nozzle.

In advantageous embodiments, the injector housing includes a nozzle body, a throttle plate, a valve plate and a retaining body which are braced together axially by means of a nozzle-clamping nut. This is a very advantageous structure of a fuel injector, especially of a fuel injector having a hydraulic pilot valve which, in turn, can be activated, for example, by an electromagnetic actuator. Fuel injectors of this type are operated by variation of hydraulic pressures. Detection of pressures and pressure differences is therefore of especially great advantage with such fuel injectors, firstly in order to determine the injection characteristic curve, but also, secondly, in order to obtain the desired injection characteristic curve robustly over the service life through specified evaluation of the pressure progressions.

In a development of the disclosure, the measuring chamber is formed in the valve plate, a pilot valve seat of the pilot valve being arranged on the valve plate in order to control the nozzle needle. The force sensing element and at least parts of the hydraulic pilot valve are thereby arranged in an installation-space saving manner in a component of the injector housing, namely in the valve plate.

In an alternative development, the measuring chamber is formed in the throttle plate, the throttle plate delimiting the nozzle chamber. This, too, is an installation-space saving arrangement of the force sensing element, since the throttle plate is already a component of the injector housing in any case.

The disclosure also includes the use of a fuel injector according to the disclosure in compression-ignition internal combustion engines. In this case the system pressure prevailing in the fuel injection system is preferably more than 2000 bar.

BRIEF DESCRIPTION OF THE DRAWINGS

Further advantages, features and details of the disclosure are apparent from the following description of preferred exemplary embodiments, and from the drawings, in which.

DETAILED DESCRIPTION

Figure 1:
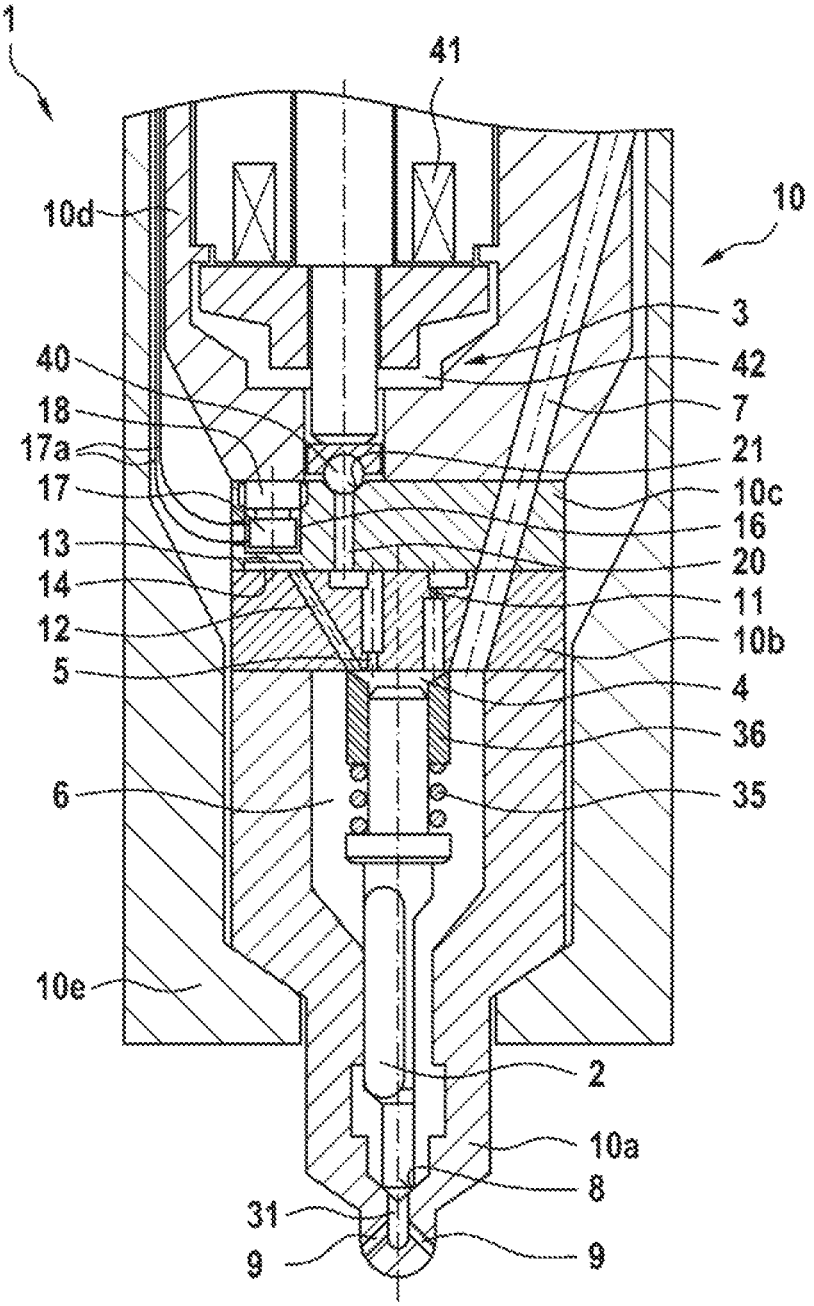
FIG. 1 shows a longitudinal section through a fuel injector according to the disclosure with a force sensing element for detecting a pressure or for detecting pressure fluctuations, only the essential regions being represented.

Like elements or elements having the same function are provided in the Figures with the same reference numerals.

FIG. 1 shows a fuel injector 1 according to the disclosure serving as a component of a so-called common rail injection system for injecting fuel into the combustion chamber of an internal combustion engine (not shown). In particular, in this case the common rail injection system has a system pressure of more than 2000 bar.

The fuel injector 1 comprises a injector housing 10 which in the exemplary embodiment represented comprises essentially four components adjoining one another in the axial direction: on the side facing towards the combustion chamber (not shown) of the internal combustion engine the injector housing 10 has a nozzle body 10*a* adjoined by a throttle plate 10*b* which in turn is a adjoined on the side facing away from the nozzle body 10*a* by a valve plate 10*c* and a retaining body 10*d*. These components of the injector housing 10 are braced together axially in a sealing manner by a nozzle clamping nut 10*e*.

A blind hole 31 having at least one, but preferably a plurality of spray holes 9 for injecting the pressurized fuel into the combustion chamber of the internal combustion engine, is formed in the nozzle body 10*a*. The nozzle body 10*a* forms in a bore-shaped recess a nozzle chamber 6 which is, connected hydraulically via a feed line 7 to a fuel source, for example a common rail. A reciprocatingly movable injection member in the form of a nozzle needle 2 is arranged inside the nozzle chamber 6.

A nozzle seat 8 with which the nozzle needle 2 cooperates to open and close the spray holes 9 is arranged on the nozzle body 10*a*.

The nozzle needle 2 is guided radially in the nozzle chamber 6 by the nozzle body 10*a*, the nozzle needle 2 being loaded by a force in the direction of the nozzle seat 8 by a closing spring 35. At its end facing away from the nozzle seat 8 the nozzle needle 2 delimits with an end face a control chamber 4. The control chamber 4 is formed in the injector housing 10 between the nozzle needle 2, the throttle plate 10*b* and a sleeve 36. The control chamber 4 is connected to the feed line 7 by a feed throttle 11 formed in the throttle plate 10*b*. The sleeve 36 is tensioned against the throttle plate 10*b* by the closing spring 35 and guides the nozzle needle 2 in a longitudinally movable manner, while the nozzle needle 2 positions the sleeve 36 in the radial direction. The pressure in the control chamber 4 loads the nozzle needle 2 with a hydraulic force in the direction of the nozzle seat 8, that is, in the closing direction.

The pressure in the control chamber 4 is controlled by a pilot valve 3 arranged in the injector housing 10. The pilot valve 3 comprises a closing body 40, which cooperates with a pilot valve seat 21 configured on the valve plate 10*c*, an actuator 41 and a valve chamber 20. In the exemplary embodiment in FIG. 1 the actuator 41 is shown as an electromagnetic actuator, but may also be any kind of actuator, for example, a piezo actuator. The valve chamber 20 is connected to the control chamber 4 via a return throttle 5 formed in the throttle plate 10*b*. By interacting with the pilot valve seat 21, the closing body 40 opens and closes a connection between the valve chamber 20 and a low-pressure chamber 42 configured in the injector housing 10. In the exemplary embodiment of FIG. 1 the valve chamber 20 includes essentially two bores, formed respectively in the valve plate 10*c* and in the throttle plate 10*b*. In alternative embodiments, however, the valve chamber 20 may have any desired form.

According to the disclosure, a force sensing element 17 is arranged in the injector housing 10 in order to measure a pressure in a pressure chamber 14 subjected to high pressure. Two electrical conduits 17*a* lead from the force sensing element 17 through the injector housing 10 to a control device (not shown). The stroke movement of the nozzle needle 2, and therefore the injection characteristic curve of the fuel injector 1, can be derived directly from the force or pressure measurement. The activation of the pilot valve 3 can then, for example, be varied by the control device as a function of the injection characteristic curve.

The pressure chamber 14 is connected hydraulically to the feed line 7, to the nozzle chamber 6, to the control chamber 4 or to the valve chamber 20. In the exemplary embodiment of FIG. 1 the pressure chamber 14 is formed by a recess in the valve plate 10*c* and is connected to the control chamber 4 via a tap hole 12 formed in the throttle plate 10*b*.

Furthermore, a measuring chamber 16 is formed in the valve plate 10*c* opposite the pressure chamber 14, from which it is separated by a diaphragm-like intermediate wall 13. The force sensing element. 17 is arranged in the measuring chamber 16, and specifically in such a way that it supports the intermediate wall 13.

The measuring chamber 16 is the form of a blind hole open towards the retaining body 10*d*. The force sensing element 17 can thereby be braced against the intermediate wall 13 either by means of an overdimension with respect to the retaining body 10*d* or, as in the exemplary embodiment of FIG. 1, by means of a screw element 18 screwed into the measuring chamber 16.

The measuring chamber 16 is located in the low-pressure region, while the pressure chamber 14 is subjected to high pressure. This has the result that the intermediate wall 13 is loaded hydraulically on one side. The preloading of the intermediate wall 13 by the force sensing element 17 compensates for this one-sided loading. The maximum stresses, in particular tensile stresses, in the intermediate wall 13 are thereby reduced and the service life of the entire fuel injector 1 is therefore increased.

Further embodiments of the fuel injector 1 according to the disclosure are described below. Regions not described in detail are implemented as in the exemplary embodiment of FIG. 1.

Figure 2:
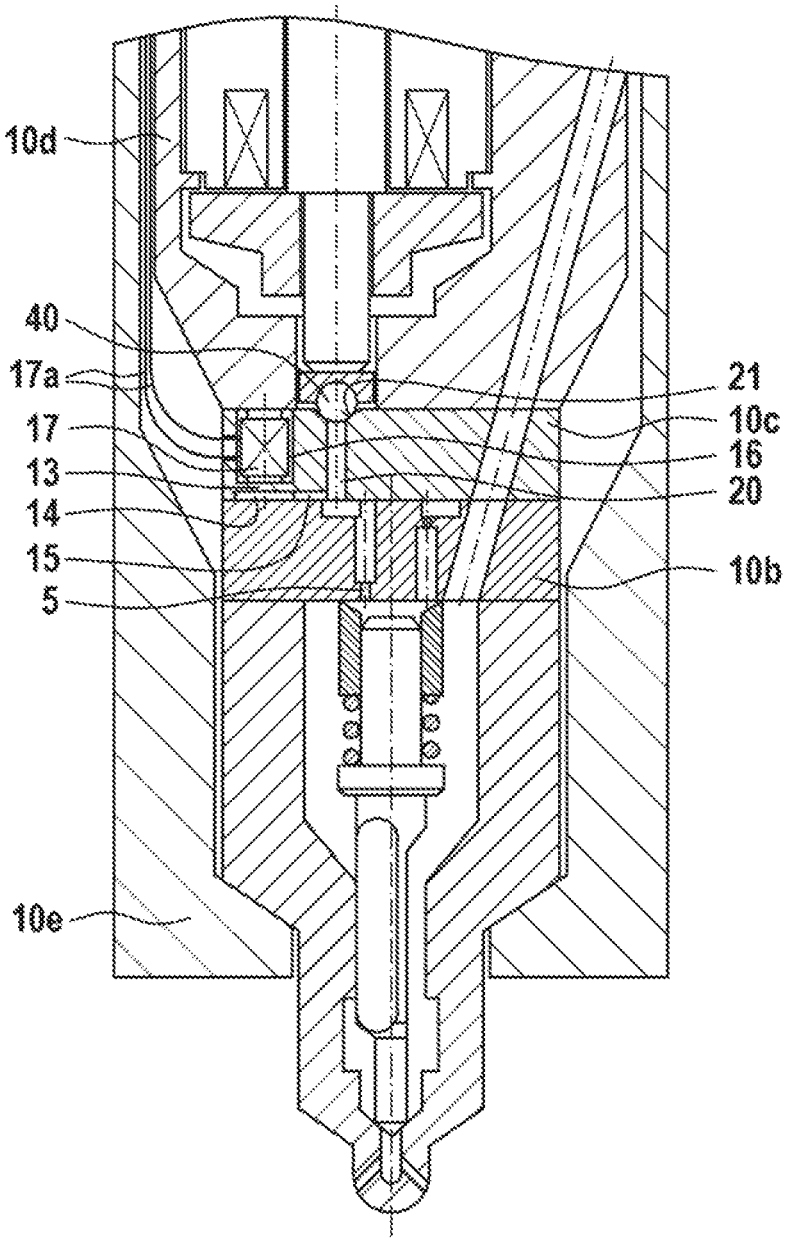
FIG. 2 shows a section of a further exemplary embodiment of the fuel injector in longitudinal section, only the essential regions being represented.

FIG. 2 shows the force sensing element 17 in an alternative arrangement, specifically with regard to the measurement of pressure in the valve chamber 20. Analogously to the embodiment in FIG. 1, the measuring chamber 16 is in the form or a blind hole in the valve plate 10*c*, the blind hole being open towards the retaining body 10*d*. The force sensing element 17 has, in the longitudinal direction of the fuel injector 1, an overdimension in relation to the measuring chamber 16. During assembly of the fuel injector 1, the force sensing element 17 is thereby preloaded between the retaining body 10*d* and the intermediate wall 13, as the nozzle clamping nut 10*e* is tightened.

On the side of the intermediate wall 13 opposite the measuring chamber 16, the pressure chamber 14 is formed as a recess in the valve plate 10*c* and is delimited by the valve plate 10*c* and the throttle plate 10*b*. The pressure chamber 14 is connected to the valve chamber 20 via a channel 15 also formed in the valve plate 10*c*, so that the pressure prevailing in the valve chamber 20 is also present in the pressure chamber 14.

In alternative embodiments the pressure chamber 14 and the channel 15 may also be implemented as a single recess. Furthermore, the pressure chamber 14 and/or the channel 15 may also be formed in the throttle plate 10*b*.

Figure 3:
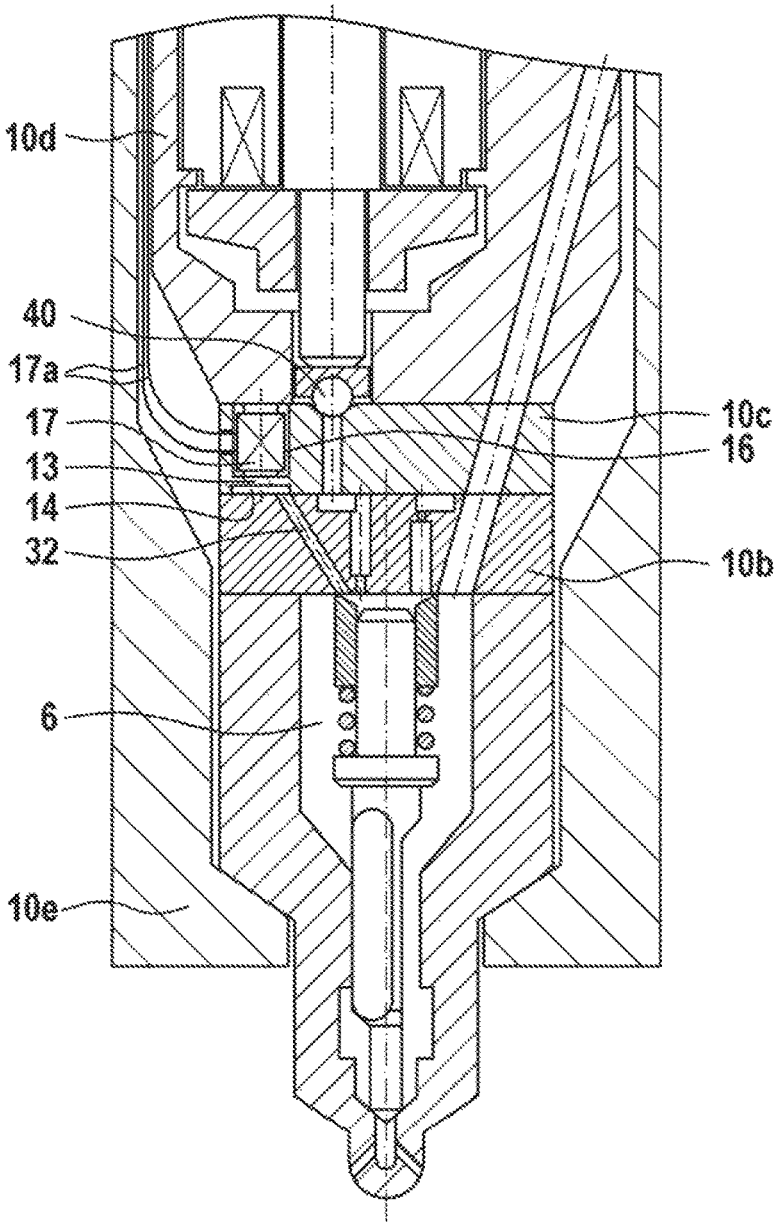
FIG. 3 shows a section of another further exemplary embodiment of the fuel injector in longitudinal section, only the essential regions being represented.

FIG. 3 shows the force sensing element 17 in a further arrangement, specifically with regard to measuring the pressure in the nozzle chamber 6. Analogously to the exemplary embodiment of FIG. 2, here the force sensing element 17 is braced in the measuring chamber 16 by means of an overdimension between the retaining body 10*d* and the intermediate wall 13. A connecting bore 32 is formed in the throttle plate 10*b* and connects the nozzle chamber 6 to the pressure chamber 14, so that the pressure prevailing in the nozzle chamber 6 is also present in the pressure chamber 14. The pressure chamber 14 is configured as a recess or blind hole in the valve plate 10*c*, but may also be formed in the throttle plate 10*b* in alternative embodiments.

Figure 4:
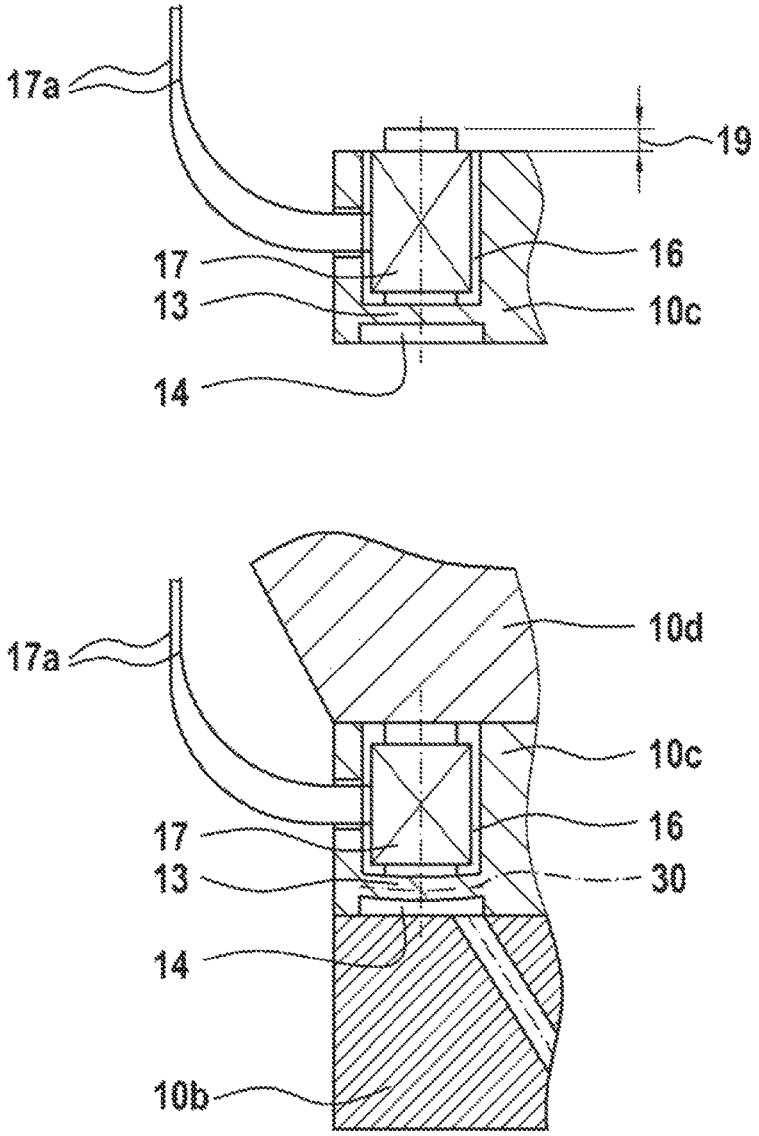
FIG. 4 shows the bracing concept of the force sensing element inside the fuel injector.

FIG. 4 shows a concept according to the disclosure for bracing the force sensing element 17 in the measuring chamber 16. The force sensing element 17 is provided with an overdimension 19 with respect to the measuring chamber 16 (FIG. 4, top). If the force sensing element 17 is now braced between the retaining body 10*d* and the intermediate wall 13, a deflection of the diaphragm-like intermediate wall 13 in the direction of the pressure chamber 14 is produced (FIG. 4, bottom). The high pressure occurring in the pressure chamber 14 during operation then counteracts the deflection of the intermediate wall 13, so that the tensile stresses in the intermediate wall 13 and in the surrounding regions are minimized during operation of the fuel injector 1.

Alternatively, it is also possible to implement the bracing of the force sensing element 17 in the measuring chamber 13 by means of a screw connection, as shown in the embodiment of FIG. 1.

Furthermore, it is also alternatively possible to form the measuring chamber 16 in the throttle plate 10*b*, so that the force sensing element 17 is arranged within the throttle plate 10*b*. The force sensing element 17 can then be braced between the throttle plate 10*b* and the valve plate 10*c*, or between the throttle plate 10*b* and the retaining body 10*d*, in the event that the measuring chamber 16 is formed, for example, as a through-bore in the valve plate 10*c*.

The operation of the fuel injector 1 according to the disclosure is as follows:

The opening and closing of the nozzle needle 2 of the fuel injector 1 is controlled by means of the pilot valve 3. When the pilot valve 3 is activated and opened by the actuator 41, so that the closing body 40 is lifted from the pilot valve seat 21, the valve chamber 20 is connected to the low-pressure chamber 42. The pressure above the nozzle needle 2 in the control chamber 4 is thereby lowered via the return throttle 5 and the pilot valve seat 21. In this way the nozzle needle 2 is moved upwards from the nozzle seat 8 by the pressure in the nozzle chamber 6 which remains equal to the system pressure, and the injection quantity reaches the combustion chamber of the internal combustion engine via the feed line 7, the nozzle chamber 6, the nozzle seat 8, the blind hole 31 and the spray holes 9.

When the pilot valve 3 is closed again the pressure in the control chamber 4 builds up again via the feed throttle 11, the nozzle needle 2 is again pressed downwards against the nozzle seat 8, and the injection is ended.

During this cycle the pressure in the control chamber 4 has a characteristic progression: with the pilot valve 3 unactuated, that is, closed, the pressure in the control chamber 4 corresponds to the pressure in the nozzle chamber 6, which corresponds to the system pressure. When the pilot valve 3 opens, the pressure in the control chamber 4 drops, since more fuel flows out of the control chamber 4 through the return throttle 5 than flows in through the feed throttle 11. Thereupon the nozzle needle 2 moves in the opening direction, that is, away from the nozzle seat 8. As long as the nozzle needle 2 is in motion, the pressure in the control chamber 4 results from the balance of forces acting on the nozzle needle 2. That is, the pressure increases in the control chamber 4 because of the rising pressure in the blind hole 31 and the resulting upward force acting on the nozzle needle 2, that is, away from the nozzle seat 8. When the nozzle needle 2 has reached its maximum stroke and rests against the upper stroke stop, a drop in the pressure in the control chamber 4 occurs in accordance with the through-flows through the return throttle 5 and the feed throttle 11.

When the pilot valve 3 is closed again, the pressure in the control chamber 4 rises until an equilibrium of the forces acting on the nozzle needle 2 is established and the nozzle needle 2 again moves in the direction of the nozzle seat 8. When the nozzle needle 2 contacts the nozzle seat 8, the pressure in the control chamber 4 finally rises again to the system pressure. These relationships between the pressure in the control chamber 4 and the strokes of pilot valve 3 and nozzle needle 2 also apply in ballistic operation of the nozzle needle 2, that is, when the injection duration is so short that the nozzle needle 2 does not reach the stroke stop.

The pressure in the control chamber 4 may be transmitted onwards, for example via the tap hole 12, to a suitable location for the pressure chamber 14. Advantageously, the pressure chamber 14 is located in the region of a flat sealing face inside the injector housing 10.

The pressure in the valve chamber 20 between the return throttle 5 and the pilot valve seat 21 also behaves in a similar manner to the pressure in the control chamber 4. That is to say that the pressure in the valve chamber 20 can also be used for assessing the movement of the pilot valve 3 and/or of the nozzle needle 2. The pressure in the valve chamber 20 may be conducted, for example, via the channel 15 to the pressure chamber 14.

Furthermore, the pressure in the nozzle chamber 6 may also be measured and used for assessing the movement of the nozzle needle 2. For example, the pressure in the nozzle chamber 6 may be conducted for this purpose through the connecting bore 32 to the pressure chamber 14.

The diaphragm-like intermediate wall 13 may be implemented in the form of the base of the blind hole or of the measuring chamber 16 in the valve plate 10*c* or in the throttle plate 10*b*. The force sensing element 17, which is very stiff in the longitudinal direction and which indirectly detects the pressure or the pressure fluctuations in the pressure chamber 14, is inserted in the measuring chamber 16. A strong support against deflection of the intermediate wall 13 is predominantly provided by the force sensing element 17. The force sensing element 17 may be, for example, a piezo force transducer which is braced against the intermediate wall 13 by the screw element 18 or by an overdimension. The diaphragm-like intermediate wall 13 is loaded by the preloading against the direction or action of the pressure to be measured in the pressure chamber 14, so that the stresses arising in the intermediate wall 13 as a result of pressure loading are minimized during operation of the fuel injector 1.

The invention claimed is:

1. A fuel injector, comprising:

an injector housing including a nozzle body, a throttle plate, a valve plate, and a retaining body, the injector housing defining a nozzle chamber, a pressure chamber, and a measuring chamber, the nozzle chamber configured to be supplied with pressurized fuel via a feed line formed in the injector housing, the pressure chamber formed in the valve plate and delimited by the throttle plate, and the pressure chamber configured to be hydraulically connected to the feed line;

a longitudinally movable nozzle needle disposed in the nozzle chamber and configured to open and to close at least one spray hole; and a force sensing element disposed in the measuring chamber and configured to at least indirectly detect a pressure in the pressure chamber, wherein the measuring chamber is separated from the pressure chamber by a diaphragm-like intermediate wall, and wherein the force sensing element supports the intermediate wall.

2. The fuel injector as claimed in claim 1, wherein the force sensing element is preloaded against the intermediate wall.

3. The fuel injector as claimed in claim 2, wherein the force sensing element is preloaded by a screw element.

4. The fuel injector as claimed in claim 2, wherein the force sensing element is preloaded by an overdimension located inside the injector housing.

5. The fuel injector as claimed in claim 1, wherein the force sensing element comprises a piezoelectric force sensing element.

6. The fuel injector as claimed in claim 1, further comprising:

a connected bore configured to connect the pressure chamber to the nozzle chamber.

7. The fuel injector as claimed in claim 1, further comprising:

a control chamber, wherein a longitudinal movement of the nozzle needle is controlled by a pressure in the control chamber.

8. The fuel injector as claimed in claim 7, further comprising:

a tap hole configured to connect the pressure chamber to the control chamber.

9. The fuel injector as claimed in claim 7, further comprising:

a pilot valve forming a valve chamber and configured to control the pressure in the control chamber; and a return throttle configured to connect the control chamber to the valve chamber.

10. The fuel injector as claimed in claim 9, further comprising:

a channel configured to connect the pressure chamber to the valve chamber.

11. The fuel injector as claimed in claim 1, wherein the feed line is connected to the pressure chamber.

12. The fuel injector as claimed in claim 1, further comprising:

a nozzle clamping nut configured to brace together the nozzle body, the throttle plate, the valve plate, and the retaining body.

13. The fuel injector as claimed in claim 12, further comprising:

a pilot valve including a pilot valve seat disposed on the valve plate and configured to control the nozzle needle, wherein the valve plate forms the measuring chamber.

14. The fuel injector as claimed in claim 13, wherein:

the throttle plate forms the measuring chamber; and the throttle plate delimits the nozzle chamber.

* * * * *